United States Patent [19]

Renault et al.

[11] 4,121,393

[45] Oct. 24, 1978

[54] DEVICE FOR PROTECTING A STRUCTURE AGAINST THE EFFECTS OF HIGH HORIZONTAL DYNAMIC STRESSES

[75] Inventors: Jean Renault, Crespieres; Francois Jolivet, La Verpilliere; Claude Plichon, Le Pecq; René Bordet, Courbevoie, all of France

[73] Assignees: Spie-Batignolles, Puteaux; Electricite de France, Paris, both of France

[21] Appl. No.: 697,632

[22] Filed: Jun. 18, 1976

[30] Foreign Application Priority Data

Jul. 1, 1975 [FR] France ..... 75 20654
Oct. 31, 1975 [FR] France ..... 75 33393

[51] Int. Cl.[2] ..... E04H 9/02

[52] U.S. Cl. ..... 52/167; 14/16.5; 428/674

[58] Field of Search ..... 52/167; 29/196.6, 164; 14/16 B

[56] References Cited

U.S. PATENT DOCUMENTS

| | | | |
|---|---|---|---|
| 2,055,000 | 9/1936 | Bacigalupo | 52/167 |
| 2,690,074 | 9/1954 | Jones | 52/167 |
| 2,950,576 | 8/1960 | Rubenstein | 52/167 |
| 3,105,252 | 10/1963 | Milk | 52/167 |
| 3,233,376 | 2/1966 | Naillon | 52/167 |
| 3,349,418 | 10/1967 | Hein | 52/167 |
| 3,638,377 | 2/1972 | Caspe | 52/167 |
| 3,716,348 | 2/1973 | Perkins | 29/196.6 |
| 3,736,712 | 6/1963 | Muto | 52/167 |

FOREIGN PATENT DOCUMENTS

| | | | |
|---|---|---|---|
| 1,271,346 | 7/1968 | Fed. Rep. of Germany | 52/167 |
| 2,327,055 | 11/1975 | Fed. Rep. of Germany | 52/167 |
| 2,327,057 | 12/1975 | Fed. Rep. of Germany | 52/167 |
| 2,334,332 | 1/1975 | Fed. Rep. of Germany | 52/167 |
| 2,254,974 | 7/1975 | France | 52/167 |

OTHER PUBLICATIONS

Physics by Semat & Kravitz, ©1958, p. 50.

*Primary Examiner*—Ernest R. Purser
*Assistant Examiner*—H. E. Raduazo
*Attorney, Agent, or Firm*—Young & Thompson

[57] ABSTRACT

The device for protecting a structure against the effects of dynamic stresses and especially stresses produced by earthquakes comprises a system of friction supports constituted by seating blocks associated respectively with the structure and with the foundation floor. The blocks are applied against each other and capable of relative displacement in frictional contact. The coefficients of static and dynamic friction of the contact surfaces range from a minimum value of approximately 0.08 to a maximum value of approximately 0.5.

5 Claims, 5 Drawing Figures

DEVICE FOR PROTECTING A STRUCTURE AGAINST THE EFFECTS OF HIGH HORIZONTAL DYNAMIC STRESSES

This invention relates to a device for protecting a structure against the effects of high horizontal dynamic stresses. By way of example, the invention is more especially applicable to the protection of buildings against earthquakes.

Even in areas of relatively low seismic activity, ordinary structures of large size are subject to rules and regulations but these are usually laid down in order to ensure protection of a probabilistic and statistical character against the occurrence of earthquakes. It does not in fact prove feasible on economic grounds to afford protection for all structures at all locations against earthquakes of all intensities, irrespective of the location of the structure with respect to the epicenter of the earthquake. Thus in some parts of France, for example, it is assumed that a building must be capable of withstanding earth tremors or shock waves which produce an acceleration having a maximum value of 0.2 g. This is in fact tantamount to an acknowledged potential risk of damage in cases of extremely low probability in which it is postulated that the most unfavorable conditions affect the majority of factors at the same time.

On the other hand there are certain structures in whicheven minor damage is liable to be attended by exceptionally serious consequences; this is the case in particular with installations for the use of nuclear energy such as nuclear power plants or installations for the storage and processing of hazardous or explosive materials. Recourse is had in such cases to intrinsic protection for removing any risk of damage, thereby ensuring that the hazardous elements proper such as a nuclear reactor core or a reservoir containing hazardous substances are endowed with an inherent capacity for resistance to high values of external stress. However, if this intrinsic protection is taken into consideration as a basis for determining the structural design of a building which is subjected to stresses of substantial magnitude, this may lead to appreciable complication of constructional arrangements and to a considerable increase in capital outlay. There is even a risk that such a course may lead to design solutions which cannot be applied in practice by means of current techniques. It is thus often found necessary to build structures which are increased in weight at the base and stiffened by high-strength reinforcing elements, and structures which are of small height or built at least partially underground. While it is true that structures erected in accordance with such concepts are massive and of substantial weight, they nevertheless do not permit accurate knowledge of the degree of safety which is really afforded. In point of fact, the forces and oscillations produced in a structure which is subjected to high dynamic stresses are a function of the nature of these external stresses, of the different degrees of stiffness of the structure and of the ground as well as the damping capacities of materials subjected to stress and forming part both of the structure and of the ground. However, the information available in regard to the value of external applied stresses is very imprecise, little is known about the plastic behavior of the ground/structure assembly, and it is impossible to verify experimentally in real magnitude the validity of the hypotheses employed in the calculations. Furthermore, the accelerations and forces induced in the equipment elements of the structure can attain values such that the use of conventional equipment and materials becomes impossible.

Finally, in the case of a zone of high seismicity and a structure which calls for absolute safety of protection against even light damage such as a nuclear power plant, for example, safety must be ensured by the intrinsic protection of the hazardous element irrespective of the probability of appearance of a maximum earthquake. Such a result can be achieved only if the degree of safety can be determined with certainty. This is practically impossible by reason of two basic imprecisions:

in the first place little is known of the dynamic behavior of the foundation soil whereas an important function is attributed to this latter by current calculation theories, in the second place the movements and accelerations of the ground which are induced by seismic waves are variable from one earthquake to another and from one terrain to another.

The aim of the present invention is to provide a solution to these problems by making it possible to limit to a known predetermined threshold value the effects of random external applied stresses and in particular the effects of horizontal accelerations arisng from an earthquake or from shock waves after an explosion.

The device for protecting a structure against the effects of dynamic and especially stresses produced by an earthquake comprises a system of friction supports constituted by seating blocks applied against each other and incorporated respectively with the structure and with the foundation floor and means for permitting the relative displacement with friction of the associated seating blocks along their mutual bearing interface.

In accordance with the invention, said device is distinguished by the fact that the coefficients of static and dynamic friction of the contact surfaces are comprised between a minimum value equal to approximately 0.08 which is compatible with the permissible displacements of the structure as a function of the structural connections and a maximum value equal to approximately 0.5 which is compatible with the threshold value of inherent resistance of said structure.

Under these conditions, the displacement of the contact surfaces of the friction supports plays a part in protecting the structure as soon as the effects of horizontal accelerations of the ground on said structure exceed a predetermined threshold value.

In a preferential embodiment of the invention, the friction supports are constituted by pairs of flat plates disposed in at least one horizontal plane, the nature, treatment and state of surface of the plates being determined as a function of the desired coefficients of friction within the limits of 0.08 to 0.5.

In a particular embodiment of the invention which is improved even further, the friction supports comprise in series with the friction surfaces at least one elastomer block and especially a laminated block.

As a further preferably feature, the device for protecting a structure against the effects of high horizontal dynamic stresses is distinguished by the fact that the nature, the surface treatment and the profile of the friction surfaces forming part of the seating blocks which are applied against each other are such that the coefficient of friction of the contact surfaces which is stable in time is substantially constant in respect of rates of displacement within the range of 0.20 and 1 m/sec approximately and in respect of bearing pressures within the range of 20 to 200 bars approximately.

Further characteristic features and advantages of the invention will become apparent from the following description, reference being made to the accompanying drawings which are given by way of example and not in any limiting sense, and in which.

Figure 1:
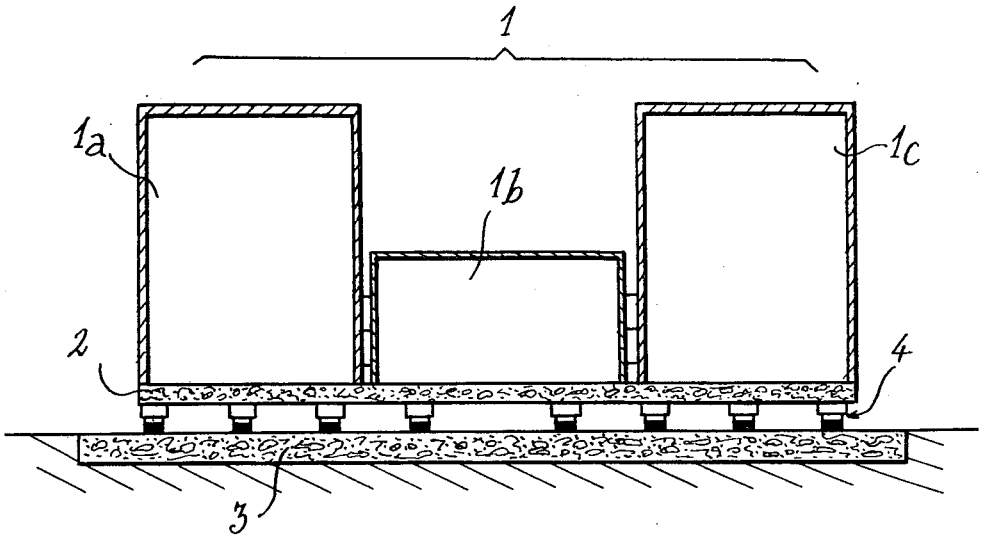
FIG. 1 is a diagrammatic sectional view of buildings of a nuclear power plant which is protected by a device in accordance with the invention.
Figure 2:
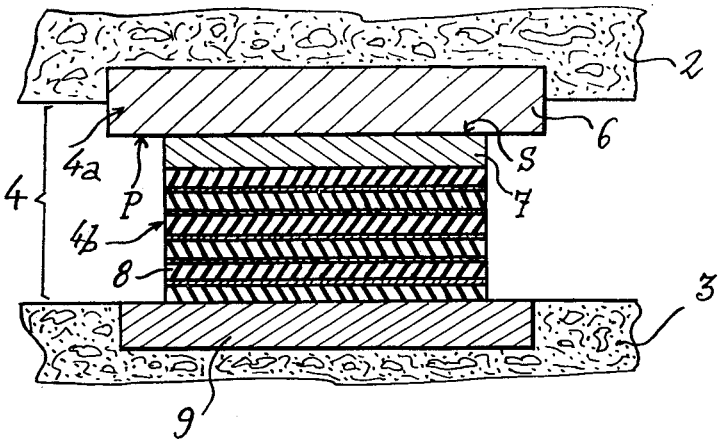
FIG. 2 is a diagrammatic detail sectional view of a friction support.

Referring to FIGS. 1 and 2 of the accompanying drawings, there is shown at 1 a structure to be protected against the destructive effects of horizontal components of earthquake. By way of example, this structure comprises a number of buildings 1*a*, 1*b*, 1*c* having different heights and weights and forming part of a nuclear power station. Thus the buildings 1*a* and 1*c* can house reactors whilst the central building 1*b* of lighter weight contains the nuclear auxiliaries. These different buildings are carried by a common reinforced concrete slab 2. The foundations of the structure are constituted by a general concrete raft 3 which is anchored in the ground.

Between the concrete slab 2 and the foundation raft 3 are interposed friction supports 4 constituted (as shown in FIG. 2) by seating blocks 4*a*, 4*b* applied against each other and incorporated respectively with the concrete slab 2 and with the foundation raft 3.

The top seating block 4*a* is constituted by a metallic plate 6 which is anchored in the concrete slab 2.

The lower seating block 4*b* has a composite structure. This block comprises a top metallic plate 7 having a smaller surface area than the plate 6 and surmounting an elastomer block 8 which is rigidly fixed both to the plate 7 and to the foundation raft 3 by means of a load distribution plate 9.

There have been shown in FIG. 2 at P and S the friction surfaces of the plates 6 and 7 which are applied against each other, the plate 6 of the seating block 4*a* being intended to perform the function of a slide-shoe and the plate 7 being intended to perform the function of a slide-table, the elastomer block 8 being thus disposed in series with the friction surfaces, in regard to the transmission of accelerations between the ground and the structure.

In order to determine the characteristics of the friction plates 6 and 7, it is first necessary to calculate the oscillations, the horizontal forces and the displacements produced within the building structure by the maximum stresses inherent in the site and in respect of variable values of the coefficient of friction. The maximum value adopted for the coefficient of friction is the value corresponding to the threshold of inherent resistance of the structure and the minimum value adopted should be such as to result in permissible displacements which are compatible with the structural connections.

The nature of the friction plates 6 and 7, the treatment of said plates, their state of surface, their profile (flat surface or arrangement of splines, striations or other surface patterns), any possible covering of said plates with synthetic protective products as well as their possible lubrication are determined so as to produce a coefficient of static friction corresponding to the threshold value of the horizontal forces defined earlier.

The solution of the problem on the basis of the rules stated in the foregoing usually makes it necessary to adopt coefficients of friction within the range of 0.08 to 0.5.

The present applicant has also established that the nature, the surface treatment and the profile of the friction surfaces P and S forming part respectively of the seating blocks 4*a* and 4*b* which are applied against each other must be such that the coefficient of friction of the contact friction surfaces P and S is substantially constant in respect of rates of displacement within the range of 0.20 to 1 m/sec approximately and in respect of bearing pressures within the range of 20 to 200 bars approximately.

This condition makes it necessary in particular to discard the following solutions:

- the use of materials which are liable to adhere to each other or to jam at the time of frictional displacement,
- the use of materials which give rise at the time of frictional displacement to physico-chemical conversion processes (such as corrosion or surface work-hardening),
- the use of sintered metals or alloys which give rise at the time of frictional displacement to the formation of powdery debris which is liable to result in modification of the coefficient of friction,
- the use of lubricating products in the state of liquid or paste by reason of the instability of such products in the course of time.

These stresses consequently impose a considerable limitation on the choice of materials which are acceptable for the manufacture of the slide-shoe of the seating block 4*a* and of the slide-table of the seating block 4*b*.

Experience has shown in particular that the plate 7 of the slide-table and the plate 6 of the slide-shoe could not both be fabricated from conventional metals or alloys. In point of fact, either these latter do not make it possible to obtain a coefficient of friction within the range of 0.08 to 0.5 or else they are not of sufficiently high strength to be capable of continuously withstanding the bearing pressure exerted on the seating blocks 4*a* and 4*b*.

The specifications which should preferably be met by materials for the manufacture of the slide-shoe (plate 6 of FIG. 2) and of the slide-table (plate 7) are indicated below.

(1) The slide-shoe (plate 6)

Since the surface P of the plate 6 which constitutes the slide-shoe projects to an appreciable extent with respect to the surface S of the plate 7, the friction surface P of the slide-shoe is highly exposed to corrosion.

In accordance with one advantageous embodiment of the invention, the plate 6 of the slide-shoe is provided at least on that surface P which is in contact with the plate 7 of the slide-table with a layer of a metal or metal alloy which is protected against corrosion.

By way of example, it is thus possible to employ a metallic plate of steel covered with a protective layer of chromium or of nickel.

It is also possible to employ a solid plate of a metal having intrinsic resistance to oxidation such as martensitic stainless steel. Ordinary stainless steel must be discarded by reason of its tendency to bind when in contact with certain metals.

It is readily apparent that the structure of the plate 6 which constitutes the slide-shoe can be composite or in other words be formed by assembling an outer plate having the requisite mechanical and corrosion-resistant properties on a support of more ordinary material such as ordinary steel or of plastic material having sufficient mechanical properties. It is possible in particular to employ a support of elastomer such as rubber in order to obtain a certain flexibility of application of the slide-shoe against the structure.

(2) The slide-table (plate 7)

The choice of material constituting the plate 7 of the slide-table is essentially guided by the need to obtain in frictional contact with the plate 6 a coefficient of friction which ranges from 0.08 to 0.5 and is stable in time.

The material constituting the plate 7 of the slide-table must be similar to the material of the plate 6 in that it affords continuous resistance to pressures within the range of 20 to 200 bars approximately.

Figure 3:
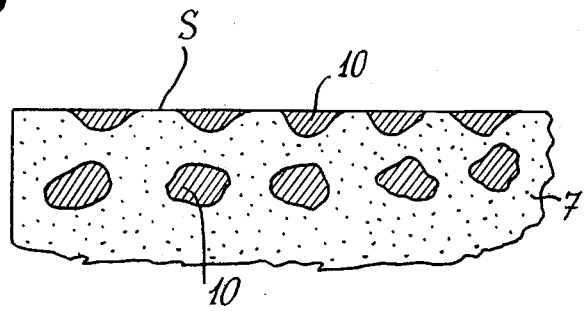
FIG. 3 is a diagrammatic sectional view of the material constituting one of the friction plates of the device in accordance with the invention.

In a preferred embodiment of the invention, said material contains (as shown in FIG. 3) at least on the surface which is in contact with the plate 6, particles 10 embedded in the material and having lubricating properties. These particles 10 preferably consist of lead, graphite, cadmium or molybdenum bisulphide.

The products mentioned in the foregoing are known for their lubricating properties but do not afford intrinsic resistance to the pressure exerted by the slide-shoe 6.

Figure 4:
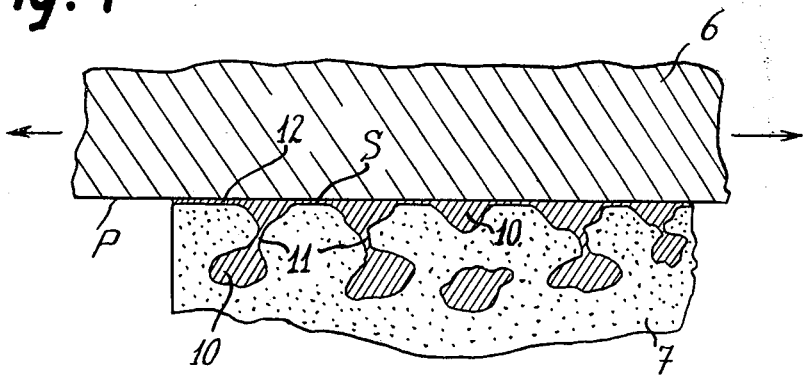
FIG. 4 is a diagrammatic sectional view of the two friction plates of the device in accordance with the invention, said plates being applied against each other.

At the time of frictional displacement (see FIG. 4), channels are formed between those particles 10 which are located near the surface of the plate 7. Under the action of pressure, part of the subjacent particles exudes towards the surface S through the channels 11, thus forming at said surface S a lubrication layer 12 which ensures in conjunction with the surface P of the plate 6 a coefficient of friction within the range of 0.08 to 0.5.

The material proper of the plate 7 can be constituted by a metal, an alloy or a plastic material having a sufficient degree of rigidity to afford continuous resistance to pressures within the range of 20 to 200 bars.

In order to obtain at the time of frictional contact with the slide-shoe 6 a lubrication layer 12 which is as uniform and continuous as possible, it is an advantage to ensure that the particles 10 of the lubricating product are distributed in the mass of the material of the plate 7 with maximum uniformity and density.

To this end it is possible to employ, for example:

- bronze or leaded copper containing lead nodules within the alloy,
- cast-iron containing graphite in lamellar or spheroidal form,
- plastic material having high mechanical strength such as the polyimides, phenoplasts or phenylene polysulphide charged with graphite particles, for example,
- a ferrous alloy such as cast-iron which has been subjected to a sulphonitriding treatment for endowing the material with surface porosity, said surface being coated with a layer of cadmium which serves to fill-up the pores.

It is an advantage in all cases to subject the surface of the slide-table 7 to preliminary grinding with a plate of the material constituting the slide-shoe 6 in order to obtain a perfectly stable coefficient of friction.

This grinding operation is in fact intended to distribute the particles 10 of solid lubricant at the surface S of the slide-table 7 in the form of a surface layer 12 which is as uniform and continuous as possible.

This grinding operation can be dispensed with in some cases by initially applying to the surface S of the slide-table 7 a thin layer of lubricating product such as lead, for example.

As is readily apparent, it is possible to incorporate in the material of the slide-table 7 a mixture of particles of different solid lubricants such as, for example, a mixture of lead powder and of graphite.

When a plastic material having high mechanical performance is employed as base material of the plate 7, there can be introduced into the plastic material additional fillers consisting, for example, of glass, asbestos or cellulose in the form of powder, fibers or woven fabrics or even rubber powder. These complementary fillers serve to adjust the mechanical properties and the coefficient of friction to the requisite values.

Certain plastics which have sufficient mechanical properties and are insensitive to moisture can be employed without any solid lubricant particles for the fabrication of the plate 7 of the slide-table. This is the case for example with the polyimides, the phenolic resins, the polyesters or phenylene polysulphide.

The use of these plastics without any solid lubricant results in coefficients of friction within the range of 0.08 to 0.15, that is, in the lower portion of the preferred range of coefficients of friction contemplated in the present invention.

A few preferred examples of materials are given below:

EXAMPLE 1

Plate 7 of leaded bronze (70% copper, 9% tin, 20% lead) which conforms to the following mechanical characteristics:

Brinell hardness number (ball diameter of 10 mm, load 500 kg): 50 approx.

Ultimate compressive strength: 7 to 8 kg/mm$^2$.

This bronze contains lead nodules which are uniformly distributed in the mass and have a mean size of less than 400 microns.

After application of a thin film of lead (a few microns in thickness), there is obtained with a plate 6 of martensitic stainless steel a coefficient of friction equal to 0.18 in respect to rates of displacement within the range of 0.20 to 1 m/sec and bearing pressures within the range of 20 to 200 bars.

EXAMPLE 2

Plate 7 of lamellar graphitized cast-iron, type A (ASTM standard).

After grinding of the surface, there is obtained with a plate 6 of martensitic stainless steel a coefficient of friction equal to 0.14 in the case of rates of displacement within the range of 0.20 to 1 m/sec and bearing pressures within the range of 20 to 200 bars.

EXAMPLE 3

Plate 7 of ordinary cast-iron which has been subjected to a sulphonitriding treatment in order to produce a porous surface.

After application of a thin film of cadmium (about ten microns in thickness) so as to fill the surface pores of the cast-iron, a coefficient of friction equal to 0.18 is obtained with a plate 6 of martensitic stainless steel. This coefficient of friction remains substantially constant when the rate of displacement is varied between 0.20 and 1 m/sec and the bearing pressure is varied between 20 and 200 bars.

EXAMPLE 4

Plate 7 constituted by an asbestos fabric element impregnated with a phenolic resin.

A coefficient of friction equal to 0.13 is obtained with a plate 6 of ordinary stainless steel. The measured coefficient of friction remains substantially constant when the rate of displacement is caused to vary between 0.20 and 1 m/sec and the bearing pressure is within the range of 20 to 200 bars.

Figure 5:
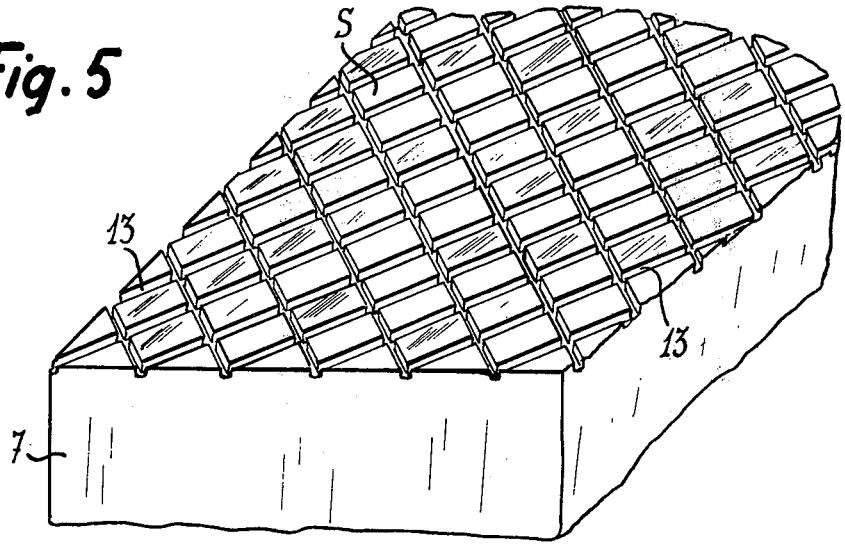
FIG. 5 is a fragmentary view in perspective showing the surface of one of the plates in accordance with an alternative embodiment of the invention.

In some cases, it is an advantage to ensure that the surface S of the plate 7 is provided with grooves 13 as indicated in FIG. 5 or alternatively with channels, holes or the like. The grooves 13 in fact make it possible to collect any abrasion debris which is liable to be formed at the time of mutual friction of the surfaces S and P. This accordingly prevents said debris from resulting in a modification of the coefficient of friction.

As indicated in FIG. 2, the seating block **4*b* preferably comprises an elastomer block 8 constituted by a set of plates of elastomer such as neoprene which are joined to each other by means of steel plates. This elastomer block 8 is intended to endow the seating block 4*b*** with a certain degree of flexibility with a view to permitting compensation for surface irregularities of the horizontal plane or planes and especially to permitting vibration of the different points of the structure in phase and at a frequency which differs as far as possible from the frequencies of the seismic vibrations generated in the ground in order to prevent resonances.

The elastomer block 8 provided by the invention thus makes it possible to reduce the oscillation frequency of the structure to 1 Hz approximately whereas the frequency produced by vibration of the ground is usually 4 to 5 Hz.

In addition, since all the points of the structure vibrate in phase, the accelerations at the level of the various stages are all of the same sign, thus avoiding the existence at certain points of the building of accelerations having opposite directions and sometimes very high peak values.

By way of example, the block 8 can have a total thickness of 10 cm and each neoprene plate can have a thickness of 12 mm.

The number and surface area of the seating blocks 4 are governed by the maximum permissible rate of compression in the case of neoprene and by the advantage of ensuring an equal load distribution between the seating blocks. It is thus apparent (as shown in FIG. 1) that provision is made for a smaller number of seating blocks 4 directly beneath the central building **1*b*, the weight of which is lower than that of the buildings 1*a*, 1*c***.

Also by way of example in a particular case of a building which occupies a ground area of 640 $m^2$, provision has been made for 1000 friction supports of the type shown in FIG. 2.

The connection between the elastomer block 8 and the plate 7 which constitutes the slide-table must be capable of withstanding the horizontal stresses produced at the time of frictional contact with the plate 6 which constitutes the slide-shoe. Depending on the nature of the materials employed, this connection can be obtained by bonding, welding, riveting, bolting or by means of jointing of the tongue-and-groove or dovetail type. An excellent connection can be formed by molding the elastomer 8 within recesses or grooves formed in the plate 7.

It is therefore apparent from the foregoing description that the reinforcement of structures which are liable to be subjected to high dynamic stresses can be limited to a reasonable value by means of the device in accordance with the invention. In particular, the device makes it possible in areas of high seismic activity to erect structures requiring a degree of safety which is known with certainty and the resistance of which has been tested in areas of low seismic activity. A structure which is protected in this manner offers inherent resistance to the forces for which it has been designed and is unaffected by the applied stress when this latter becomes excessive.

In practice, the coefficients of friction of the friction supports are between the limits of 0.08 to 0.5 approximately. In fact, in the case of lower values corresponding to rolling supports or to a sliding movement, for example of polytetrafluoroethylene on stainless steel, the smallest value of applied stress would result in a substantial displacement without any absorption of energy. In the case of higher values of the coefficient of friction, the supports would consequently be too rigidly coupled with the foundations and the inherent resistance to be given to the structure would accordingly become excessive.

A further advantage of the invention is that a building structure designed for given seismic conditions can be utilized under different seismic conditions by virtue of a simple adaptation of the friction supports.

The combination of a reinforced and laminated elastomer block which works under shearing stress in series with the friction supports further provides essential and specific advantages as has already been noted earlier.

It will be clearly understood that the invention is not strictly limited to the examples which have been given in the foregoing. From this it follows that designs differing from the invention only in detail or applying either to portions of structures or to structures which are not built on a general foundation raft will not be considered to constitute any departure from the scope of this invention. Similarly, it is not necessary to ensure that all the friction supports are located in the same horizontal plane. However, all the supports must clearly be located in horizontal parallel planes.

The relative positions of the elastomer block 8 and of the friction plates 6 and 7 can likewise be reversed and the same applies to the relative positions of the friction plates themselves.

The contour and the dimensions of the friction plates can be chosen indifferently without modifying the invention in any respect.

We claim:

1. A construction protected against the effects of high horizontal dynamic stresses and vibrations of seismic origin, said construction resting on foundations by a plurality of seating block means each comprising in combination a) friction means for permitting relative horizontal displacement of the construction with respect to the foundations, said friction means absorbing at least part of the energy of said horizontal dynamic stresses, said friction means having two horizontal friction surfaces in contact with each other, said friction surfaces having a predetermined coefficient of static and dynamic friction comprised between a minimum value which is compatible with the permissible displacements of the construction as a function of the structural connections of the construction and a maximum value which is compatible with the threshold value of inherent resistance of said construction, said minimum and maximum values being chosen within the range between 0.08 and 0.5, the nature, the surface treatment and the profile of said friction surfaces being such that said coefficient of friction is stable in time and substantially constant and lies in said range in respect of maximum rates of displacement within the range of 0.20 to 1 m/sec approximately and in respect of bearing pressures within the range of 20 to 200 bars approximately; and b) elastomer blocks supporting the weight of the construction and dimensioned such that the vibration of the different points of the construction is in phase and is maintained below 4 Hz, thereby to prevent resonance of the construction with the frequency of the seismic vibrations.

2. A construction according to claim 1, wherein said in phase vibration of the different points of the construction is at a frequency of about 1 Hz.

3. A construction according to claim 1, wherein the seating blocks comprise an upper bearing plate of stainless steel resting on a lower plate of leaded bronze, said leaded bronze containing lead nodules distributed in the mass and having a mean size of less than 400 microns, the contact surface between said two plates having a coefficient of friction equal to about 0.18.

4. A construction according to claim 1, wherein the seating blocks comprise an upper bearing plate of stainless steel resting on a lower plate of lamellar graphitized cast-iron, the contact surfaces between said two plates having a coefficient of friction equal to about 0.14.

5. A construction according to claim 1, wherein the seating blocks comprise an upper bearing plate of stainless steel resting on a lower plate of cast-iron which has been subjected to a sulphonitriding treatment in order to produce a porous surface, the surface of said lower plate adjacent to the upper plate being coated by a film of cadmium, the contact surfaces between said two plates having a coefficient of friction equal to about 0.18.

* * * * *